US011408418B2

(12) United States Patent
Bromfield et al.

(10) Patent No.: US 11,408,418 B2
(45) Date of Patent: Aug. 9, 2022

(54) INDUSTRIAL CONTROL SYSTEM FOR DISTRIBUTED COMPRESSORS

(71) Applicant: Rockwell Automation Technologies, Inc., Mayfield Heights, OH (US)

(72) Inventors: Scotty Bromfield, Johannesburg (ZA); Andries Ernst Kruger, Johannesburg (ZA); Jonathan Armstrong, Johannesburg (ZA); Mithun Mohan Nagabhairava, Waukegan, IL (US); Timothy L. Stanford, Meqon, WI (US); Chidiebere U. Egbuna, Houston, TX (US)

(73) Assignee: Rockwell Automation Technologies, Inc., Mayfield Heights, OH (US)

( * ) Notice: Subject to any disclaimer, the term of this patent is extended or adjusted under 35 U.S.C. 154(b) by 252 days.

(21) Appl. No.: 16/539,752

(22) Filed: Aug. 13, 2019

(65) Prior Publication Data

US 2021/0048016 A1 Feb. 18, 2021

(51) Int. Cl.

| | |
|---|---|
| ***F04B 49/08*** | (2006.01) |
| ***F04B 41/06*** | (2006.01) |
| ***F04B 49/06*** | (2006.01) |
| ***F04B 41/02*** | (2006.01) |
| ***F04D 27/00*** | (2006.01) |
| ***F04D 25/16*** | (2006.01) |

(52) U.S. Cl.

CPC ..... *F04B 49/08* (2013.01); *F04B 41/02* (2013.01); *F04B 41/06* (2013.01); *F04B 49/065* (2013.01); *F04D 25/16* (2013.01); *F04D 27/001* (2013.01); *F04B 2203/0208* (2013.01); *F04B 2205/09* (2013.01); *F04B 2205/16* (2013.01); *F04B 2205/172* (2013.01); *F04B 2207/01* (2013.01); *F04B 2207/02* (2013.01)

(58) Field of Classification Search

CPC ..... F04B 49/08; F04B 49/065; F04B 41/06; F04B 2203/0208; F04B 2205/09; F04B 2205/16; F04B 2205/172; F04B 2207/01; F04B 2207/02; F04D 25/16; F04D 27/001

USPC ..... 417/3, 5–8

See application file for complete search history.

(56) References Cited

U.S. PATENT DOCUMENTS 4,502,842 A * 3/1985 Currier ..... F04B 49/065 417/53

4,580,947 A * 4/1986 Shibata ..... F04B 49/022 417/38

(Continued)

*Primary Examiner* — Christopher S Bobish

(57) ABSTRACT

A method for operating a plurality of geographically distributed compressors, wherein the outputs of the geographically distributed compressors are coupled to a compressed air distribution system within an industrial automation environment, is provided. The method includes receiving performance data from the plurality of compressors, and receiving current environment data from a plurality of sensors within the industrial automation environment, including at least some sensors within the compressed air distribution system. The method also includes assigning a guide vane weight to each compressor based at least in part on a capacity of each compressor, identifying a target system air pressure, and processing the performance data, current environment data, guide vane weights, and target system air pressure to determine control settings for each of the plurality of compressors.

18 Claims, 6 Drawing Sheets

(56) References Cited

U.S. PATENT DOCUMENTS

| | | | | |
|---|---|---|---|---|
| 5,343,384 | A * | 8/1994 | Fisher | G05B 15/02 700/4 |
| 5,743,714 | A * | 4/1998 | Drob | F04D 27/0261 417/2 |
| 5,743,715 | A * | 4/1998 | Staroselsky | F04D 27/0269 417/6 |
| 6,602,057 | B2 * | 8/2003 | Saxena | F01D 17/06 417/286 |
| 7,955,056 | B2 * | 6/2011 | Pettersson | G05D 16/2073 417/53 |
| 8,073,654 | B2 * | 12/2011 | Drouart | G05B 17/02 702/182 |
| 8,371,821 | B1 * | 2/2013 | Mehr | F04B 47/06 417/8 |
| 10,400,776 | B2 * | 9/2019 | Grassens | F04D 27/0253 |
| 10,976,245 | B2 * | 4/2021 | Waxman | G01M 3/202 |
| 2008/0131258 | A1 * | 6/2008 | Liepold | F04D 27/0269 415/1 |
| 2008/0210317 | A1 * | 9/2008 | Conry | F04D 27/02 137/565.33 |
| 2010/0082293 | A1 * | 4/2010 | Mitchell | G05B 19/0428 702/182 |
| 2016/0032935 | A1 * | 2/2016 | Schwarz | F25J 3/04884 417/43 |
| 2016/0168979 | A1 * | 6/2016 | Zhang | G01M 10/00 73/152.61 |
| 2017/0356346 | A1 * | 12/2017 | Jiang | F04D 27/0292 |
| 2018/0282633 | A1 * | 10/2018 | Van de Cotte | C07C 5/333 |

* cited by examiner

INDUSTRIAL CONTROL SYSTEM FOR DISTRIBUTED COMPRESSORS

TECHNICAL BACKGROUND

Compressed air is a common energy source that is used within multiple industries and is used extensively in the mining industry. The nature of the process requires a constant supply of air at a designated pressure to ensure that operations continue as designed. Multiple compressors need to work together to meet the demand. To achieve this, the multiple compressors are connected in parallel to ensure that collectively they can meet the demand. The prevention of unnecessary stopping and starting of the equipment is important as this medium voltage megawatt system is not capable of frequent switching.

OVERVIEW

In an embodiment, a universal compressor controller for operating a plurality of geographically distributed compressors, wherein the outputs of the geographically distributed compressors are coupled to a compressed air distribution system within an industrial automation environment, is provided. The universal compressor controller includes a control module, configured to control the plurality of geographically distributed compressors, and an analysis module, coupled with the control module.

The analysis module is configured to receive performance data from the plurality of compressors, wherein the outputs of the plurality of compressors are coupled to a compressed air distribution system within the industrial automation environment, and to receive current environment data from a plurality of sensors within the industrial automation environment, including at least some sensors within the compressed air distribution system.

The analysis module is further configured to assign a guide vane weight to each compressor based at least in part on a capacity of each compressor, and to identify a target system air pressure.

The universal compressor controller further includes an optimization module, coupled with the control module and the analysis module. The optimization module is configured to process the performance data, current environment data, guide vane weights, and target system air pressure to determine control settings for each of the plurality of compressors.

In another embodiment, a method for operating a plurality of geographically distributed compressors, wherein the outputs of the geographically distributed compressors are coupled to a compressed air distribution system within an industrial automation environment, is provided. The method includes receiving performance data from the plurality of compressors, and receiving current environment data from a plurality of sensors within the industrial automation environment, including at least some sensors within the compressed air distribution system.

The method also includes assigning a guide vane weight to each compressor based at least in part on a capacity of each compressor, identifying a target system air pressure, and processing the performance data, current environment data, guide vane weights, and target system air pressure to determine control settings for each of the plurality of compressors.

In a further embodiment, one or more non-transitory computer-readable media having stored thereon program instructions to operate a plurality of geographically distributed compressors, wherein the outputs of the geographically distributed compressors are coupled to a compressed air distribution system within an industrial automation environment, are provided.

The program instructions, when executed by a computing system, direct the computing system to at least receive performance data from the plurality of compressors; and to receive current environment data from a plurality of sensors within the industrial automation environment, including at least some sensors within the compressed air distribution system.

The program instructions further direct the computing system to at least assign a guide vane weight to each compressor based at least in part on a capacity of each compressor, identify a target system air pressure, and to process the performance data, current environment data, guide vane weights, and target system air pressure to determine control settings for each of the plurality of compressors.

This Overview is provided to introduce a selection of concepts in a simplified form that are further described below in the Technical Disclosure. It should be understood that this Overview is not intended to identify key features or essential features of the claimed subject matter, nor is it intended to be used to limit the scope of the claimed subject matter.

DETAILED DESCRIPTION

The following description and associated drawings teach the best mode of the invention. For the purpose of teaching inventive principles, some conventional aspects of the best mode may be simplified or omitted. The following claims specify the scope of the invention. Some aspects of the best mode may not fall within the scope of the invention as specified by the claims. Thus, those skilled in the art will appreciate variations from the best mode that fall within the scope of the invention. Those skilled in the art will appreciate that the features described below can be combined in various ways to form multiple variations of the invention. As a result, the invention is not limited to the specific examples described below, but only by claims and their equivalents.

Figure 1:
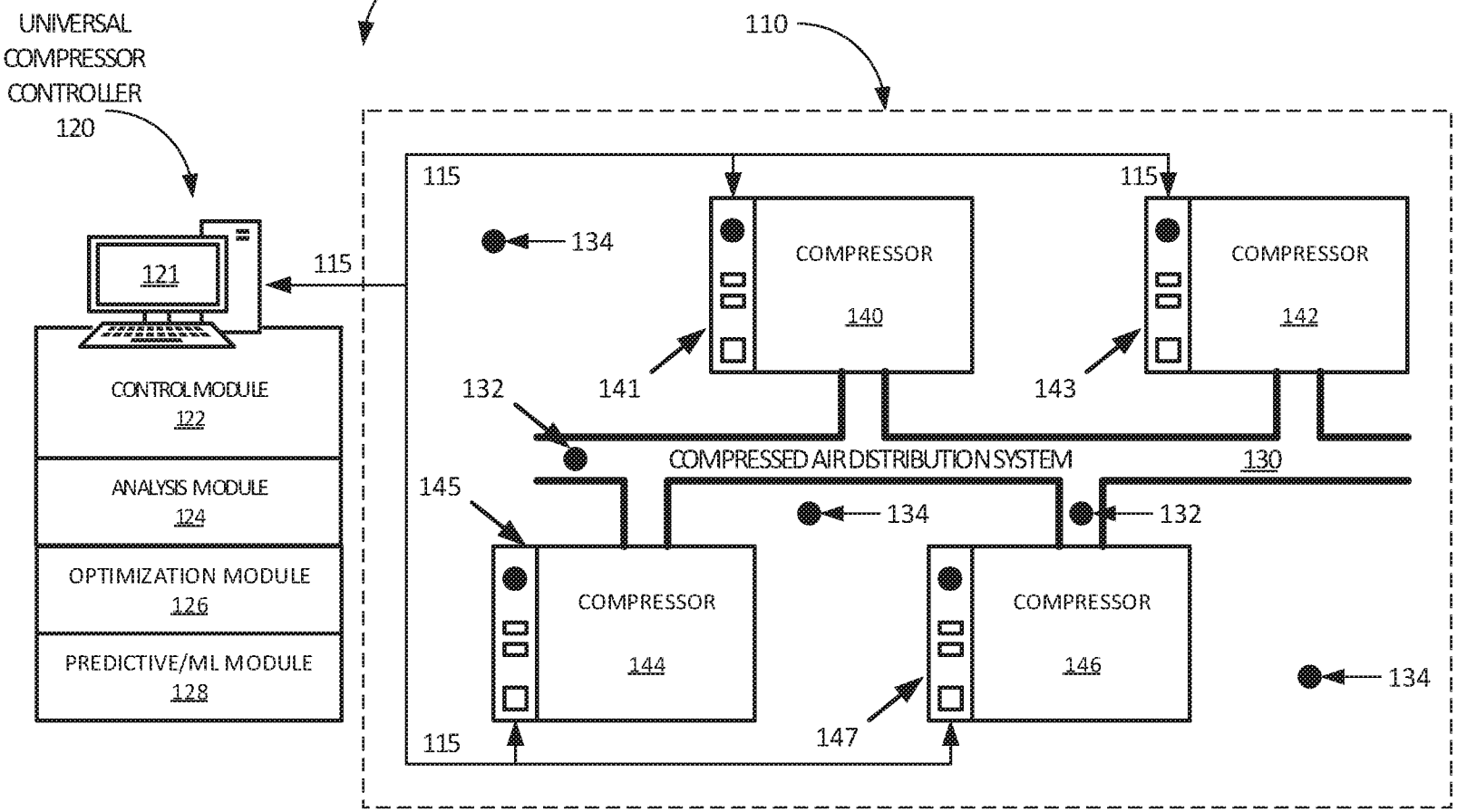
FIG. 1 illustrates an exemplary industrial automation system including a universal compressor controller.

FIG. 1 illustrates an exemplary industrial automation system 100 including a universal compressor controller 120. At a top level, this example includes universal compressor controller 120 and industrial automation environment 110. In this example, industrial automation environment 110 includes a number of compressors 140, 142, 144, and 146 whose outputs are all coupled to compressed air distribution system 130. Compressed air distribution system 130 may be huge and range geographically over several miles in order to provide power (in the form of pressurized air) to various equipment within industrial automation environment 110.

In this example, each compressor is coupled with a compressor controller. Compressor 140 is coupled with compressor controller 141, compressor 142 is coupled with compressor controller 143, compressor 144 is coupled with compressor controller 145, and compressor 146 is coupled with compressor controller 147. In operation these compressor controllers may be physically located within the chassis of the compressor, adjacent to the chassis or implemented as a separate unit electrically coupled with the compressor through a link.

Compressor controllers 141, 143, 145, and 147 communicate with universal compressor controller 120 over link 115. Compressor controllers 141, 143, 145, and 147 receive control settings for the compressors from universal compressor controller 120 over link 115, and transmit performance data from the compressors back to universal compressor controller 120 over link 115. This performance data includes such data as: compressor status, guide vane position, blow off position, discharge pressure, flow rates, and power consumption, or the like.

Industrial automation environment 110 also includes a plurality of sensors 132 and 134 which are configured to transmit current environmental data to universal compressor control 120 over link 115 or other links (not shown). This environmental data may include such data as: temperatures, air pressures, air flows, motion, vibration, and the like.

These links may use any of a variety of communication media, such as air, metal, optical fiber, or any other signal propagation path, including combinations thereof. Also, the links may use any of a variety of communication protocols, such as internet, telephony, optical networking, wireless communication, wireless fidelity, code division multiple access, worldwide interoperability for microwave access, or any other communication protocols and formats, including combinations thereof. Further, the links could be direct links or they might include various intermediate components, systems, and networks. Also, in some examples, the links may include redundant links.

In this example embodiment of the present invention, universal compressor controller 120 includes a display 121, control module 122, analysis module 124, optimization module 126, and predictive/machine learning module 128. In operation, control module 122 sends control settings to compressor controllers 141, 143, 145, and 147 over link 115.

Analysis module 124 is coupled with control module 122, and configured to receive performance data from compressor controllers 141, 143, 145, and 147 over link 115. Analysis module 124 also receives current environment data from a plurality of sensors 132, 134 within industrial automation environment 110, including at least some sensors within the compressed air distribution system 132. Analysis module 124 assigns a guide vane weight to each compressor 140, 142, 144, and 146 based at least in part on a capacity of each compressor. Analysis module 124 also identifies a target system air pressure based at least in part on the user interface for setting target system air pressures illustrated in FIGS. 5A and 5B.

Optimization module 126 is coupled with control module 122 and analysis module 124, and configured to process the performance data, current environment data, guide vane weights, and target system air pressure to determine control settings for each of the plurality of compressors. Control module 122 then transmits the control settings to compressor controllers 141, 143, 145, and 147 over link 115. One goal of optimization module 126 is to reduce the number of starts and stops required of the compressors. Large compressors take a long time to start up (some take 30 minutes or more), and repeated starts and stops cause excess wear to the compressors, requiring more frequent maintenance and replacement.

In some embodiments, optimization module 126 is also configured to calculate an efficiency for each of compressors 140, 142, 144, and 146 based on the performance data and guide vane weight, and prioritize more efficient compressors over less efficient compressors while processing the performance data, current environment data, guide vane weights, and target system air pressure to determine control settings for each of compressors 140, 142, 144, and 146. In some embodiments, optimization module 126 also processes a model of compressed air distribution system in determining control settings for the compressors. This model may be very complex and includes data such as the physical structure of compressed air distribution system 130 which may range over several miles, and have different physical and performance characteristics across its length.

In further embodiments, analysis module 124 is also configured to process the current environment data from sensors 132 and 134 and the performance data from compressor controllers 141, 143, 145, and 147 to detect a possible leak. Analysis module 124 then analyzes a geographical distribution of the compressors (such as that illustrated in FIG. 2) to estimate a location of the possible leak.

Predictive/machine learning module 128 is coupled with control module 122, analysis module 124, and optimization module 126, and is configured to monitor the performance data from compressor controllers 141, 143, 145, and 147 and the current environment data from sensors 132 and 134 over a period of time, such as a month, and to process the monitored performance data and current environment data to predict future control settings for the plurality of compressors.

This predictive function allows universal compressor controller 120 to anticipate recurring needs for extra pressure, potential failures, cyclic changes in efficiency, and the like. This machine learning module also allows universal compressor controller 120 to minimize the starts and stops of compressors 140, 142, 144, and 146, reducing wear and tear on the compressors, and to schedule maintenance of the compressors during times when less pressure is required of compressed air distribution system 130.

Figure 2:
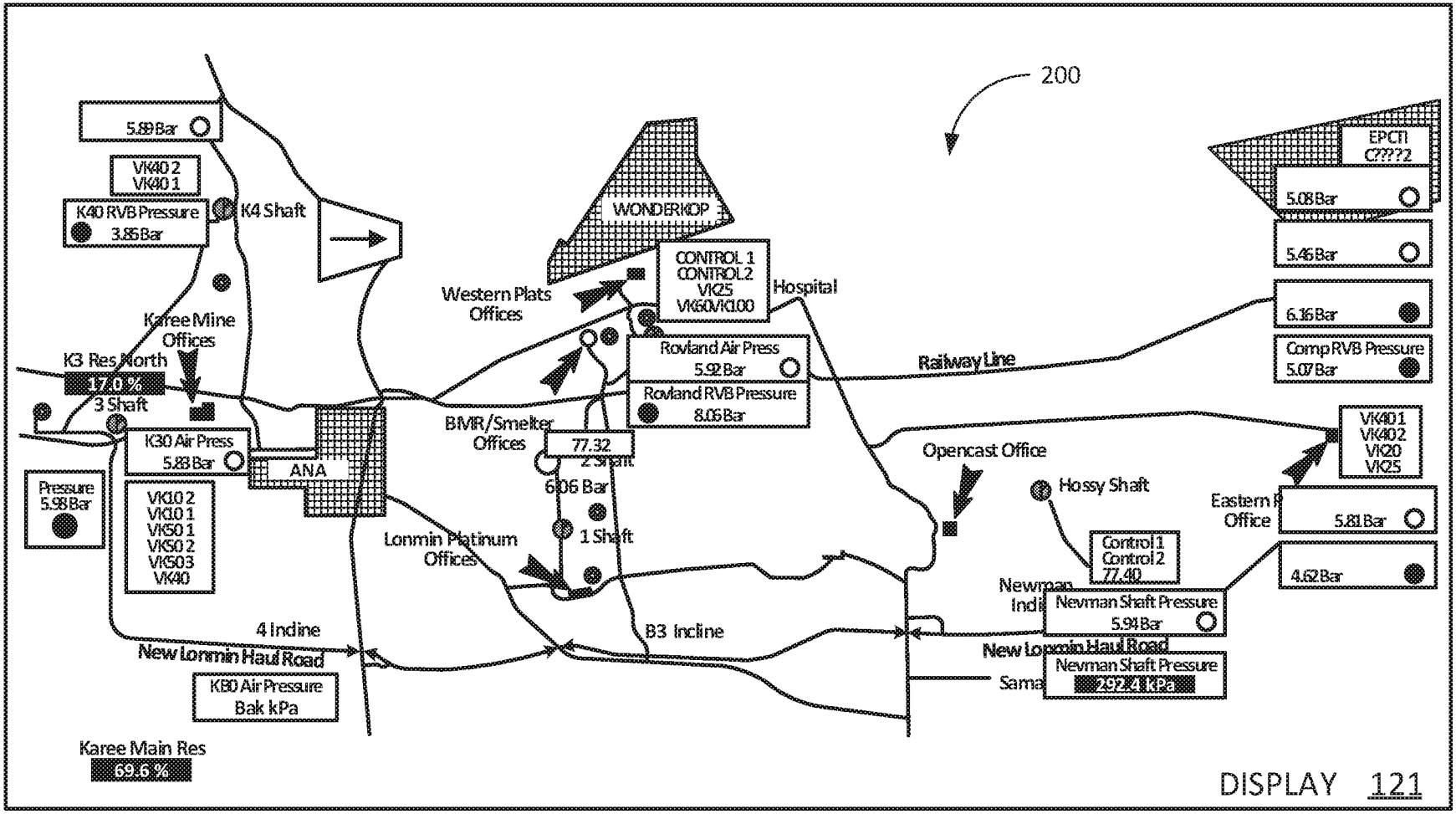
FIG. 2 illustrates an exemplary display of a universal compressor controller.

FIG. 2 illustrates an exemplary display 121 of a universal compressor controller 120. In this example, display 121 of universal compressor controller 120 provides a physical and performance model 200 of industrial automation environment 110 to a user. Here, a large mine spanning several miles and including multiple compressors is shown. The model shows the physical locations of the compressors along with some performance data for the compressors, and some sensor data from the compressed air distribution system and the mine.

Figure 3:
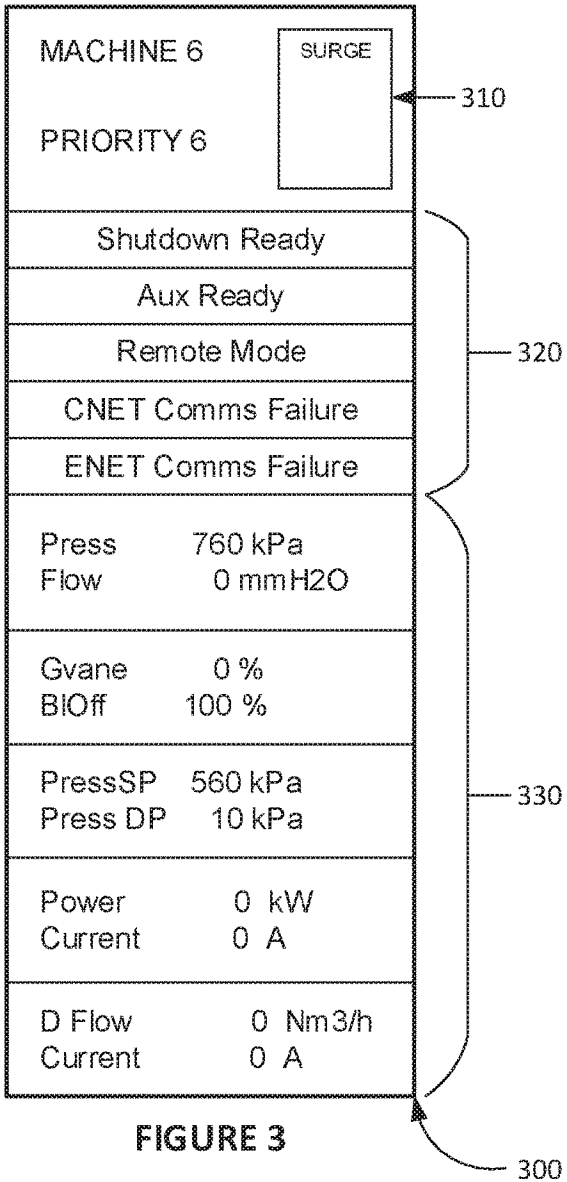
FIG. 3 illustrates an exemplary air compressor performance data display.

FIG. 3 illustrates an exemplary air compressor performance data display 300. In this example, status, control, and performance data for a single compressor is shown on display 121. This example for Machine 6 having a Priority of 6, includes a SURGE control button 310, a number of status indicators 320, and a listing of some performance data 330 for the compressor. This allows a user to quickly see the status of each compressor.

Figure 4:
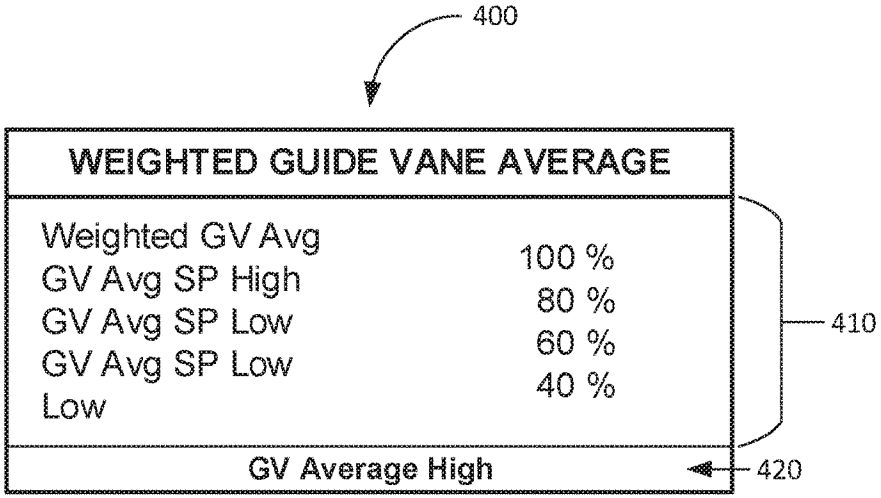
FIG. 4 illustrates an exemplary weighted guide vane average display.

FIG. 4 illustrates an exemplary weighted guide vane average display 400. Each compressor in the system is assigned a guide vane weighting which corresponds to the capacity of the compressor. The guide vane average is the sum of the individual products of the compressors actual guide vane position and guide vane weighting displayed as a percentage 410. High guide vane averages indicate high demand for pressurized air, while low guide vane averages indicate low demand for pressurized air. This display 400 also includes an indicator 420 for displaying warnings and/or errors.

Figure 5A:
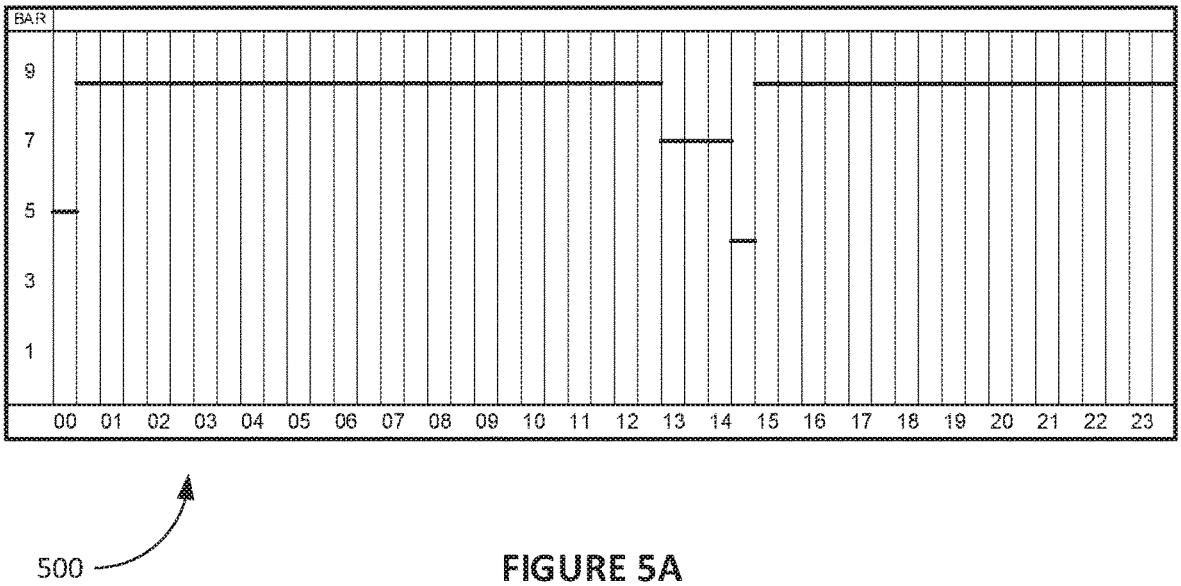
FIG. 5A illustrates an exemplary user interface for setting target system air pressures.

FIG. 5A illustrates an exemplary user interface 500 for setting target system air pressures. In this example, a user interface 500 is provided to allow a user to set target system air pressures in 30-minute intervals. Here the pressure ranges up to 9 bars, and sliders allow a user to choose any target pressure up to that value. This allows users to conserve air pressure during down times such as shift changes, while providing sufficient air pressure when needed.

Figure 5B:
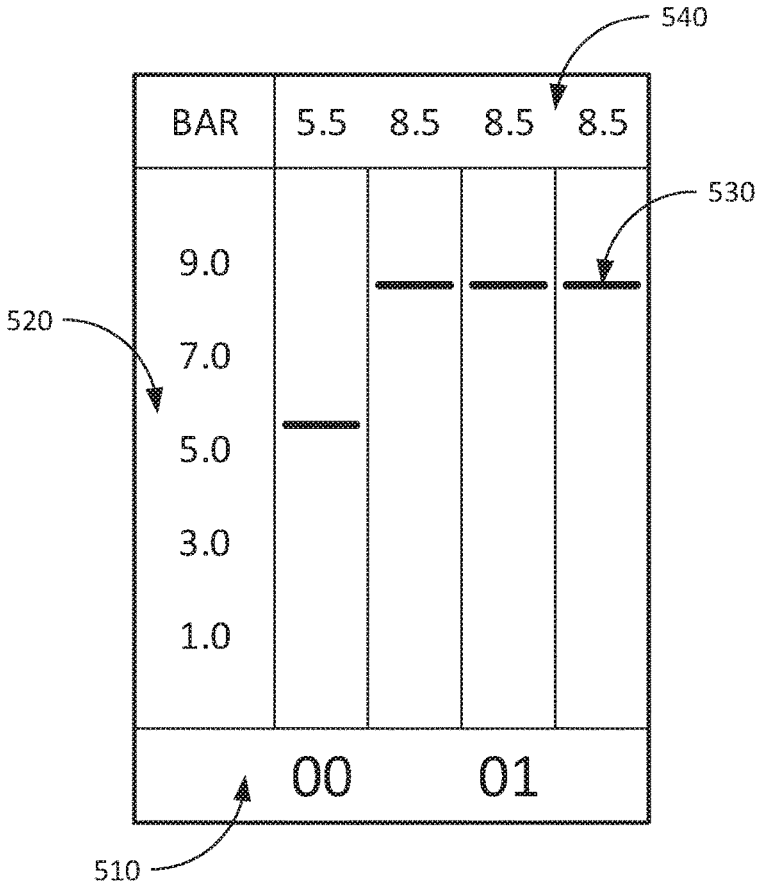
FIG. 5B illustrates the exemplary user interface for setting target system air pressures from FIG. 5A in further detail.

FIG. 5B illustrates the exemplary user interface 500 for setting target system air pressures from FIG. 5A in further detail. This example illustrates the left portion of the user interface 500 from FIG. 5A as enlarged. The bottom row 510 of user interface 500 indicates the time of day for each setting. The left column 520 indicates air pressure in bars. The user is able to move sliders 530 for each 30-minute interval to an appropriate air pressure setting, which is illustrated in decimal numbers 540 across the top of user interface 500.

Figure 6:
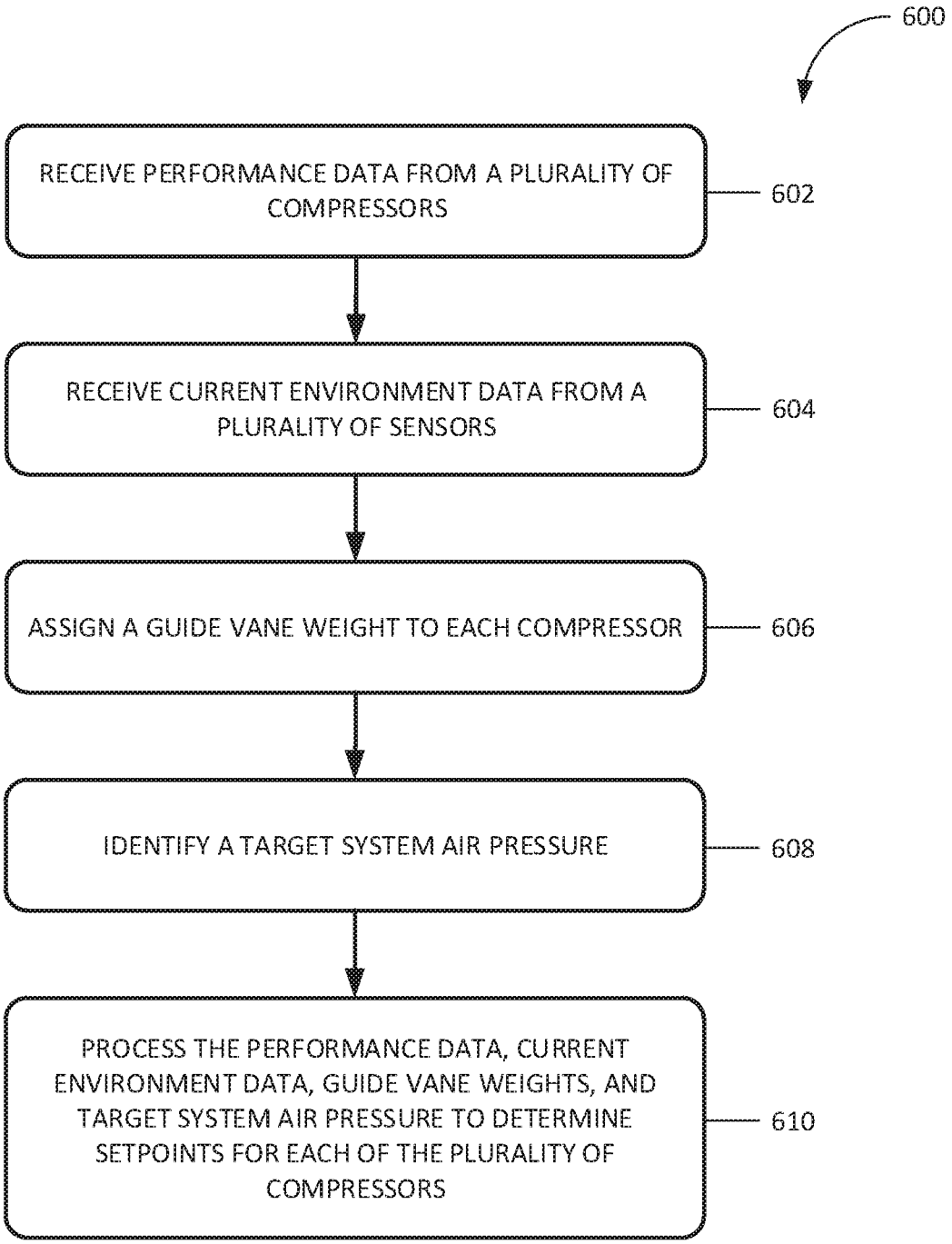
FIG. 6 illustrates a flow chart of an exemplary method for operating a universal compressor controller within an industrial automation environment.

FIG. 6 illustrates a flow chart 600 of an exemplary method for operating a universal compressor controller 120 for operating a plurality of geographically distributed compressors 140, 142, 144, and 146, wherein the outputs of the geographically distributed compressors 140, 142, 144, and 146 are coupled to a compressed air distribution system 130 within an industrial automation environment 110.

In this example embodiment, universal compressor controller 120 receives performance data from the plurality of compressors, (operation 602). The performance data may include such data as: compressor status, guide vane position, blow off position, discharge pressure, flow rates, and power consumption.

Universal compressor controller 120 receives current environment data from a plurality of sensors 132 and 134 within the industrial automation environment 110, including at least some sensors 132 within the compressed air distribution system 130, (operation 604).

Universal compressor controller 120 assigns a guide vane weight to each of the plurality of compressors 140, 142, 144, and 146, (operation 606). As discussed above, with respect to FIG. 4, guide vane weights correspond to the capacity of the individual compressor.

Universal compressor controller 120 identifies a target system air pressure 530, (operation 608). As discussed above, with respect to FIGS. 5A and 5B, this target system air pressure 530 may be determined by a user in 30-minute intervals, according to an example embodiment of the present invention.

Universal compressor controller 120 processes the performance data, current environment data, guide vane weights, and target system air pressure to determine control settings for each of the plurality of compressors, (operation 610).

Figure 7:
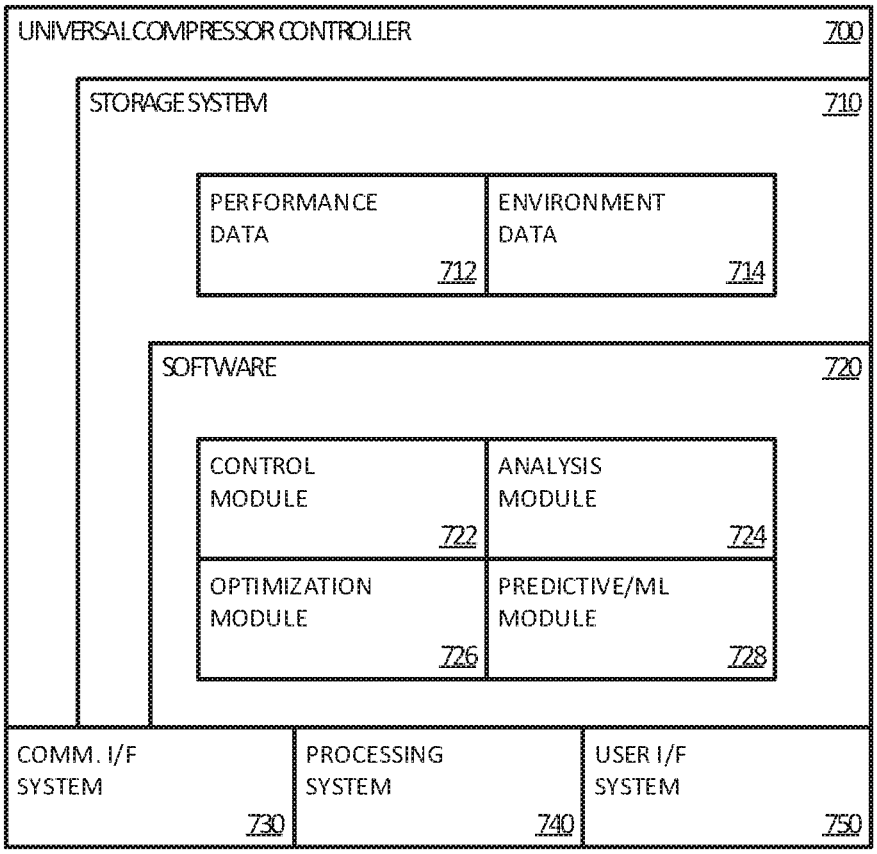
FIG. 7 illustrates an exemplary universal compressor controller within an industrial automation system.

FIG. 7 illustrates an exemplary universal compressor controller 700, such as universal compressor controller 120 from FIG. 1, within an industrial automation system, such as industrial automation system 100 from FIG. 1.

Universal compressor controller 700 includes user interface system 750, communication interface system 730, processing system 740, and storage system 710. Storage system 710 in the example shown includes software 720. In some examples, software 720 comprises control module 722, analysis module 724, optimization module 726 and predictive/machine learning module 728, that together configure the universal compressor controller 700, when executed by the universal compressor controller 700 in general or processing system 740 in particular, to direct universal compressor controller 700 to perform industrial automation operations, such as operating a plurality of geographically distributed compressors, wherein the outputs of the geographically distributed compressors are coupled to a compressed air distribution system within an industrial automation environment as illustrated in FIG. 6. Other data, such as performance data 712, and environment data 714, is also stored in storage system 710. In an example embodiment, performance data 712 includes such data as: compressor status, guide vane position, blow off position, discharge pressure, flow rates, and power consumption, or the like, as described herein.

Processing system 740 may comprise a microprocessor and other circuitry that retrieves and executes software 720 from storage system 710. Processing system 740 may be implemented within a single processing device, but may also be distributed across multiple processing devices or subsystems that cooperate in executing program instructions. Examples of processing system 740 include general purpose central processing units, application specific processors, and logic devices, as well as any other type of processing device, combinations, or variations.

Storage system 710 may comprise any computer readable storage media readable by processing system 740 and capable of storing software 720. Storage system 710 may include volatile and nonvolatile, removable and non-removable media implemented in any method or technology for storage of information, such as computer readable instructions, data structures, program modules, or other data. Storage system 710 may be independent from or integrated into processing system 740. Storage system 710 can comprise additional elements, such as a memory controller, capable of communicating with processing system 740. Examples of storage media include random access memory, read only memory, magnetic disks, optical disks, flash memory, virtual memory and non-virtual memory, magnetic cassettes, magnetic tape, magnetic disk storage or other magnetic storage devices, or any other suitable storage media. In no case is the storage media a propagated signal.

In addition to storage media, in some implementations storage system 710 may also include communication media over which software 720 may be communicated internally or externally. Storage system 710 may be implemented as a single storage device but may also be implemented across multiple storage devices or sub-systems co-located or distributed relative to each other. Storage system 710 may comprise additional elements capable of communicating with processing system 740 or possibly other systems.

Software 720 may be implemented in program instructions and among other functions and may, when executed by processing system 740, direct processing system 740 to operate as described herein. In particular, the program instructions may include various components or modules that cooperate or otherwise interact to implement at least a portion of universal compressor controller 700. The various components or modules may be embodied in compiled or interpreted instructions or in some other variation or combination of instructions. The various components or modules may be executed in a synchronous or asynchronous manner, in a serial or in parallel, in a single threaded environment or multi-threaded, or in accordance with any other suitable execution paradigm, variation, or combination thereof. Software 720 in the examples comprises computer programs, firmware, or some other form of machine-readable processing instructions. Software 720 may include an operating system, utilities, drivers, network interfaces, applications, virtual machines, or some other type of software. Software 720 may include additional processes, programs, or components, such as operating system software or other application software. Software 720 may also comprise firmware or some other form of machine-readable processing instructions executable by processing system 740.

In general, software 720, when loaded into processing system 740 and executed, may transform a suitable apparatus, system, or device from a general-purpose computing system into a special-purpose computing system customized to assist in operating a plurality of geographically distributed compressors, wherein the outputs of the geographically distributed compressors are coupled to a compressed air distribution system within an industrial automation environment, among other operations. Indeed, encoding software 720 on storage system 710 may transform the physical structure of storage system 710. The specific transformation of the physical structure may depend on various factors in different implementations of this description. Examples of such factors may include, but are not limited to the technology used to implement the storage media of storage system 710 and whether the computer-storage media are characterized as primary or secondary storage, as well as other factors.

User interface system 750 may include communication connections and devices that allow for communication with users over a communication network or collection of networks. User interface system 750 may include user input and output devices for being controlled by a user, or these devices may be external to universal compressor controller 700.

User interface system 750 may comprise a network card, network interface, port, or interface circuitry that allows universal compressor controller 700 to communicate over a network or networks. User interface system 750 may also include a memory device, software, processing circuitry, or some other device. User interface system 750 can use any suitable communication protocol to exchange communications with a user.

User interface system 750 may include components that communicate over communication links, such as network cards, ports, RF transceivers, processing circuitry and software, or other communication components. User interface system 750 may be configured to communicate over electrically conductive, wireless, optical, or other links.

User interface system 750 can further include components that interact with a user to receive user inputs and user communications and to present media and/or information. These components typically include a keyboard, display, indicator lights, speakers, touch pads, microphone, buttons, mouse, or other user input/output apparatus, including combinations thereof.

Communication interface system 730 may include communication connections and devices that allow for communication with computers, such as compressor controllers 141, 143, 145, and 147, over a backplane, a communication network, or a collection of networks.

Communication interface system 730 may comprise a network card, network interface, port, or interface circuitry that allows universal compressor controller 700 to communicate over a network or networks. Communication interface system 730 may also include a memory device, software, processing circuitry, or some other device. Communication interface system 730 can use any suitable communication protocol to exchange communications with another computer.

Communication interface system 730 may include components that communicate over communication links, such as network cards, ports, RF transceivers, processing circuitry and software, or other communication components. Communication interface system 730 may be configured to communicate over electrically conductive, wireless, optical, or other links.

The above description and associated figures teach the best mode of the invention. The following claims specify the scope of the invention. Note that some aspects of the best mode may not fall within the scope of the invention as specified by the claims. Those skilled in the art will appreciate that the features described above can be combined in various ways to form multiple variations of the invention. As a result, the invention is not limited to the specific embodiments described above, but only by the following claims and their equivalents.

What is claimed is:

1. A universal compressor controller for operating a plurality of compressors which are geographically distributed, wherein outputs of the plurality of compressors are coupled to a compressed air distribution system within an industrial automation environment, the universal compressor controller comprising:

a control module, configured to control the plurality of compressors;

an analysis module, coupled with the control module, and configured to:

receive a model of the compressed air distribution system including a physical structure of the compressed air distribution system;

receive performance data from the plurality of compressors;

receive current environment data from a plurality of sensors within the industrial automation environment, including at least some sensors within the compressed air distribution system;

assign a guide vane weight to each of the plurality of compressors based at least in part on a capacity of each compressor; and identify a target system air pressure; and an optimization module, coupled with the control module and the analysis module, and configured to:

process the model of the compressed air distribution system, performance data, current environment data, guide vane weights, and target system air pressure to determine control settings for each of the plurality of compressors.

2. The universal compressor controller of claim 1, wherein the optimization module is further configured to:

calculate an efficiency for each of the plurality of compressors based on the performance data and guide vane weight; and prioritize more efficient compressors over less efficient compressors while processing the performance data, current environment data, guide vane weights, and target system air pressure to determine control settings for each of the plurality of compressors.

3. The universal compressor controller of claim 1, wherein the analysis module is further configured to:

process the current environment data and the performance data to detect a possible leak; and analyze a geographical distribution of the plurality of compressors to estimate a location of the possible leak.

4. The universal compressor controller of claim 1, further comprising:

a machine learning module, coupled with the control module, the analysis module, and the optimization module, and configured to:

monitor the performance data and the current environment data over a period of time; and process the monitored performance data and current environment data to predict future control settings for the plurality of compressors.

5. The universal compressor controller of claim 1, wherein processing the model of the compressed air distribution system, performance data, current environment data, guide vane weights, and target system air pressure to determine control settings for each of the plurality of compressors includes minimizing compressor starts and stops.

6. The universal compressor controller of claim 1, wherein the performance data comprises compressor status, guide vane position, blow off position, discharge pressure, flow rates, and power consumption.

7. A method for operating a plurality of compressors which are geographically distributed, wherein outputs of the plurality of compressors are coupled to a compressed air distribution system within an industrial automation environment, the method comprising:

receiving a model of the compressed air distribution system including a physical structure of the compressed air distribution system;

receiving performance data from the plurality of compressors;

receiving current environment data from a plurality of sensors within the industrial automation environment, including at least some sensors within the compressed air distribution system;

assigning a guide vane weight to each of the plurality of compressors based at least in part on a capacity of each compressor;

identifying a target system air pressure; and processing the model of the compressed air distribution system, performance data, current environment data, guide vane weights, and target system air pressure to determine control settings for each of the plurality of compressors.

8. The method of claim 7, further comprising:

calculating an efficiency for each of the plurality of compressors based on the performance data and guide vane weight; and prioritizing more efficient compressors over less efficient compressors while processing the performance data, current environment data, guide vane weights, and target system air pressure to determine control settings for each of the plurality of compressors.

9. The method of claim 7, further comprising:

processing the current environment data and the performance data to detect a possible leak; and analyzing a geographical distribution of the plurality of compressors to estimate a location of the possible leak.

10. The method of claim 7, further comprising:

monitoring the performance data and the current environment data over a period of time; and processing the monitored performance data and current environment data within a machine learning module to predict future control settings for the plurality of compressors.

11. The method of claim 7, wherein processing the model of the compressed air distribution system, performance data, current environment data, guide vane weights, and target system air pressure to determine control settings for each of the plurality of compressors includes minimizing compressor starts and stops.

12. The method of claim 7, wherein the performance data comprises compressor status, guide vane position, blow off position, discharge pressure, flow rates, and power consumption.

13. One or more non-transitory computer-readable media having stored thereon program instructions to operate a plurality of compressors which are geographically distributed, wherein outputs of the plurality of compressors are coupled to a compressed air distribution system within an industrial automation environment, wherein the program instructions, when executed by a computing system, direct the computing system to at least:

receive a model of the compressed air distribution system including a physical structure of the compressed air distribution system;

receive performance data from the plurality of compressors;

receive current environment data from a plurality of sensors within the industrial automation environment, including at least some sensors within the compressed air distribution system;

assign a guide vane weight to each of the plurality of compressors based at least in part on a capacity of each compressor;

identify a target system air pressure; and process the model of the compressed air distribution system, performance data, current environment data, guide vane weights, and target system air pressure to determine control settings for each of the plurality of compressors.

14. The one or more non-transitory computer-readable media of claim 13, further comprising program instructions, which when executed by the computing system, direct the computing system to at least:

calculate an efficiency for each of the plurality of compressors based on the performance data and guide vane weight; and prioritize more efficient compressors over less efficient compressors while processing the performance data, current environment data, guide vane weights, and target system air pressure to determine control settings for each of the plurality of compressors.

15. The one or more non-transitory computer-readable media of claim 13, further comprising program instructions, which when executed by the computing system, direct the computing system to at least:

process the current environment data and the performance data to detect a possible leak; and analyze a geographical distribution of the plurality of compressors to estimate a location of the possible leak.

16. The one or more non-transitory computer-readable media of claim 13, further comprising program instructions, which when executed by the computing system, direct the computing system to at least:

monitoring the performance data and the current environment data over a period of time; and processing the monitored performance data and current environment data within a machine learning module to predict future control settings for the plurality of compressors.

17. The one or more non-transitory computer-readable media of claim 13, wherein processing the model of the compressed air distribution system, performance data, current environment data, guide vane weights, and target system air pressure to determine control settings for each of the plurality of compressors includes minimizing compressor starts and stops.

18. The one or more non-transitory computer-readable media of claim 13, wherein the performance data comprises compressor status, guide vane position, blow off position, discharge pressure, flow rates, and power consumption.

* * * * *